United States Patent [19]

Wexler

[11] Patent Number: 4,884,966

[45] Date of Patent: Dec. 5, 1989

[54] PROTECTIVE CAKE COVER AND CANDLE HOLDER

[76] Inventor: Ethel Wexler, 23108 L'Ermitage Cir., Boca Raton, Fla. 33433

[21] Appl. No.: 233,537

[22] Filed: Aug. 10, 1988

Related U.S. Application Data

[63] Continuation-in-part of Ser. No. 80,915, Aug. 3, 1987, abandoned.

[51] Int. Cl.[4] ..... F23D 3/16; A47G 19/30

[52] U.S. Cl. ..... 431/295; 312/284; D7/83

[58] Field of Search ..... 431/253, 295, 288, 289; 428/7; 426/106, 128; 312/280, 284; D7/83; 206/32, 45, 551; D26/9, 10, 12

[56] References Cited

U.S. PATENT DOCUMENTS

| | | | |
|---|---|---|---|
| D. 256,844 | 9/1980 | Conn | D26/10 |
| D. 285,159 | 8/1985 | Wexler | D7/83 |
| 1,125,855 | 1/1915 | Mapes | 431/295 |
| 2,758,458 | 8/1956 | Carlson | D7/83 X |
| 3,690,902 | 9/1972 | Dahl | 312/284 X |
| 3,736,214 | 5/1973 | McBirnie | 312/284 X |
| 3,819,455 | 6/1974 | MacKendrick | 431/295 X |
| 4,197,940 | 4/1980 | DeRosset | 312/284 X |
| 4,219,119 | 8/1980 | Zefran | D7/83 X |
| 4,375,862 | 3/1983 | Kurinsky et al. | 312/284 X |

FOREIGN PATENT DOCUMENTS

| | | | |
|---|---|---|---|
| 220566 | 4/1962 | Austria | 431/295 |
| 584870 | 11/1958 | Italy | 431/295 |

*Primary Examiner*—Margaret A. Focarino
*Attorney, Agent, or Firm*—Alvin S. Blum

[57] ABSTRACT

Transparent plastic cover for cakes is rectangular in shape and is adjustable for rectanagular cakes of different sizes. The top has indentations to hold candles. Stand-offs are provided to raise the cover above the icing to prevent indentations from marring the icing. The indentations can be used to mark the top of the cake as a cutting guide.

24 Claims, 5 Drawing Sheets

FIG. 11
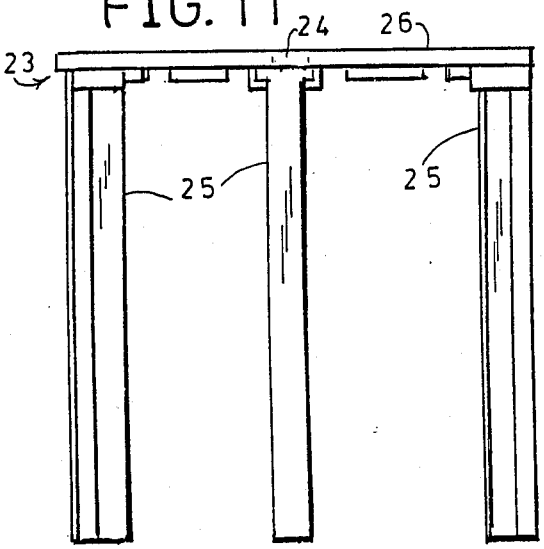
FIG. 12
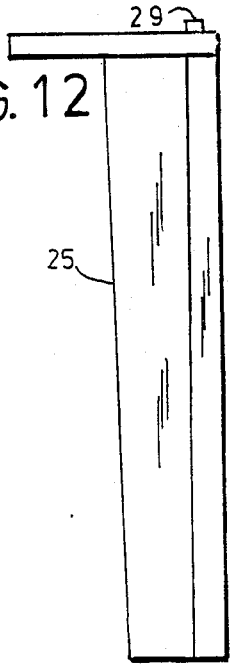
FIG. 13
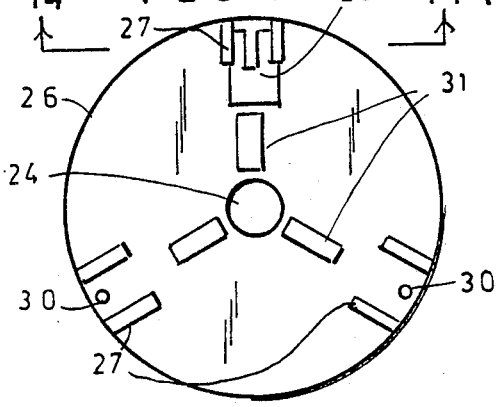
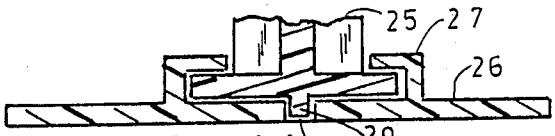
FIG. 14

PROTECTIVE CAKE COVER AND CANDLE HOLDER

This application is a continuation in part of copending application Ser. No. 080,915 filed 8/3/87 now abandoned.

BACKGROUND OF THE INVENTION

This invention relates to protective cake covers and more particularly to rectangular protective cake covers that also serve as holders for candles.

Traditionally, joyful occasions such as birthdays, anniversaries and the like are celebrated with a cake holding a plurality of lighted candles. The honored party is called upon to blow out the candles. The practice often subjects the celebrants to cake with a saliva topping. Furthermore, the insertion and removal of candles from the decorated cake top is unappetizing and unsanitary. These special cakes are often produced as rectangular "sheet" cakes of a size proportional to the size of the party.

In the cutting of a large cake, it may be difficult to divide the cake into uniform portions. Cutting guides have been devised for this purpose. MacKendrick, U.S. Pat. No. 3,819.455 and Wexler, U.S. Pat. Des. No. 285,159 teach protective cake covers that also function as candle holders for round cakes that are not adjustable.

SUMMARY OF THE INVENTION

It is, accordingly, an object of the invention to provide a cover for covering a rectangular cake to protect it from the saliva of blowing out the candles.

It is a further object to provide such a cover that will also hold the candles without substantially marring or obscuring the decorative surface of the cake.

It is also an object to provide a cover as above that is adjustable in size to accomodate cakes of different sizes.

It is yet another object to provide a cover as above that can also serve as a cutting guide.

The cover of the instant invention is comprised of a thin-walled, transparent plastic having indentations in its rectangular top for holding candles. Connected to the top are downwardly directed vertical walls. The vertical walls may terminate in a substantially horizontal flange. The candle-holding depressions in the top may be arranged to provide a cutting guide by marking indentations in the top of the cake when pressed down onto the cake.

The cover may be formed of two parts, each having three vertical sides and one open side, arranged to overlap one another at the free side to adjust one dimension of the rectangle to fit cakes of different sizes. The underside of the indentations are arranged to engage short tubes or tripods to provide supports or stand-offs to raise the cover and its many indentations above the icing on the cake. The indentations selected for engaging these supports are those whose locations do not affect the appearance of the icing.

These and other objects, features and advantages of the invention will become more fully apparent when the following detailed description of preferred embodiments of the invention is read in conjunction with the accompanying drawing.

BRIEF DESCRIPTION OF THE DRAWINGS

FIG. 11 is a front elevation view of one of the tripod elements.

FIG. 12 is a side elevation view of one of the legs of the tripod.

FIG. 13 is a bottom view of the tripod of FIG. 11.

FIG. 14 is a cross sectional view through 14—14 of FIG. 13.

DETAILED DESCRIPTION OF PREFERRED EMBODIMENTS

Figure 1:
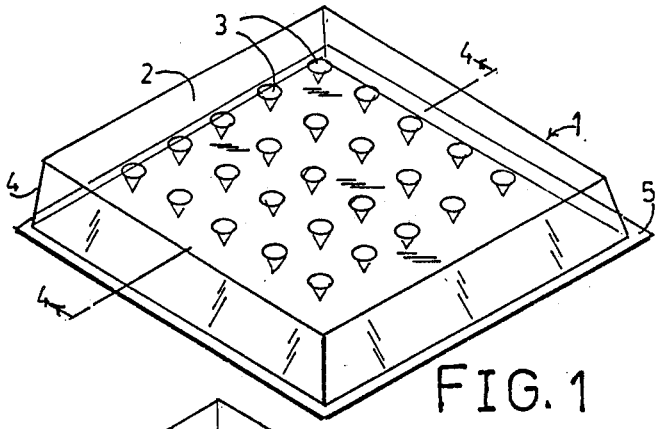
FIG. 1 is a perspective view of a non-adjustable embodiment of the invention.
Figure 4:
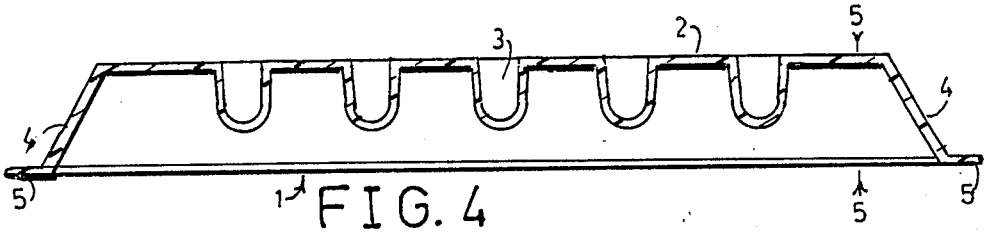
FIG. 4 is a cross sectional view taken on line 4—4 of FIG. 1.

We are referring first to FIGS. 1 and 4, illustrating a cover 1 having a flat rectangular top surface 2 having a plurality of indentations 3 shaped to receive candles. The cover is preferably vacuum formed from thin wall plastic suitable for food use. The thickness has been exaggerated in the cross sectional views for illustrative purposes. In vacuum thermoforming of sheet plastic, the shape of the cover 1, with sloping vertical sides 4 terminating in flange 5 extending completely around the cover is an optimum design because the flange 5 is generally in the plane of the original sheet. This cover has inherent rigidity derived from its shape even in thin plastic.

It is suitable for covering a cake of dimensions less than the dimensions of top 2, but it is not adjustable to cover larger cakes. Dimensions of the top 2 of fifteen inches square and a plastic thickness of two one-hundredths of an inch have been found suitable.

Figure 2:
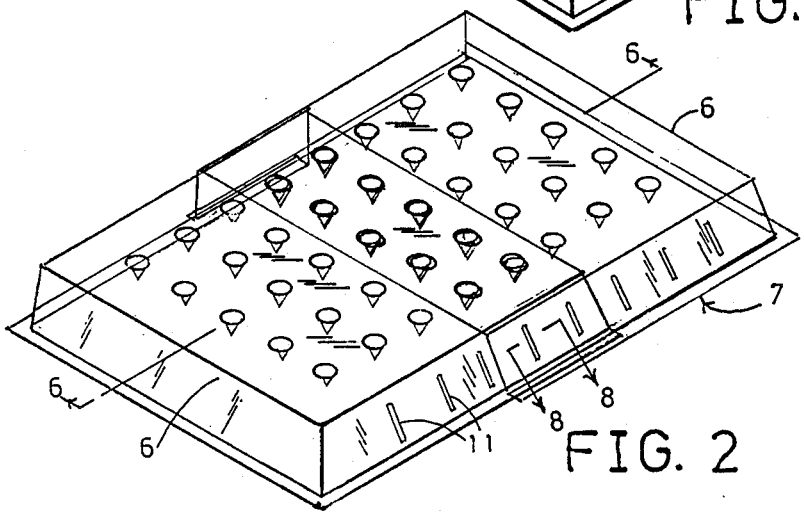
FIG. 2 is a perspective view of an adjustable embodiment of the invention.
Figure 3:
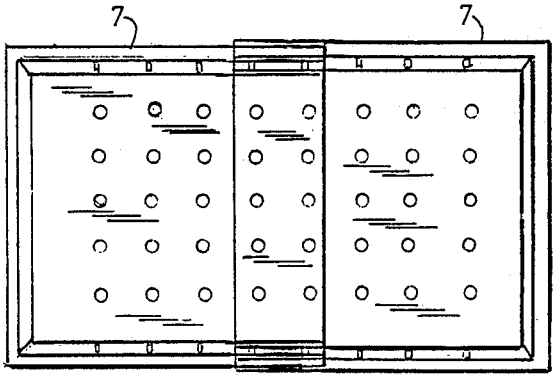
FIG. 3 is a top view of the invention.
Figure 5:
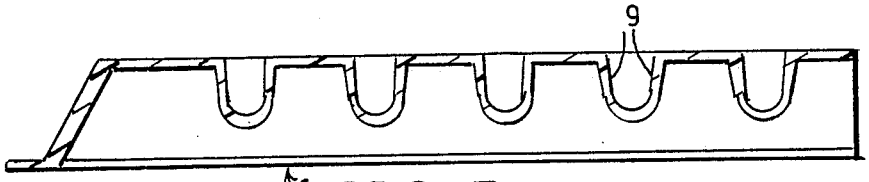
FIG. 5 is a cross sectional view of one half of the cover of FIG. 2 taken on line 6—6.
Figure 6:
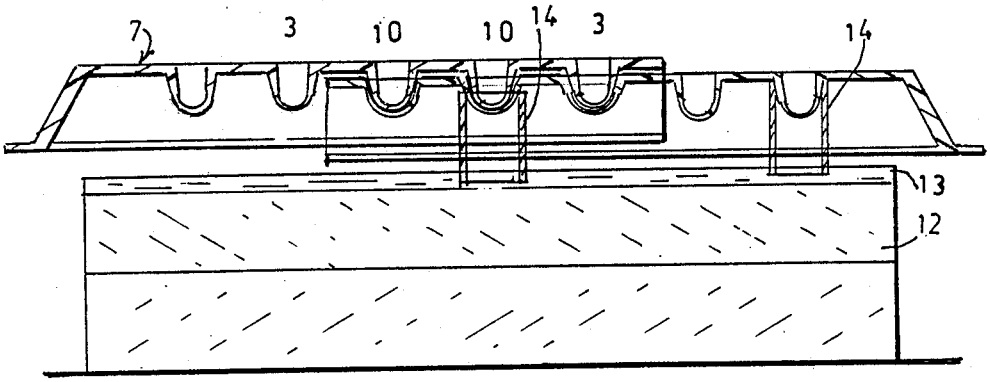
FIG. 6 is a cross sectional view of the cover of FIG. 2 taken on line 6—6 with the cover in place on a cake.
Figure 7:
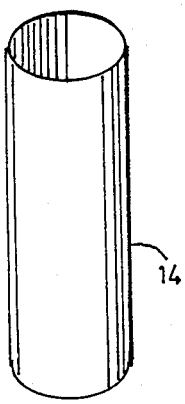
FIG. 7 is a perspective view of a tubular stand-off.
Figure 8:
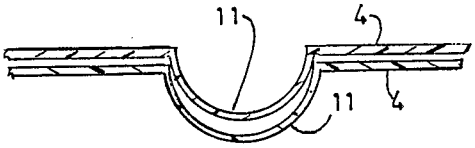
FIG. 8 is a cross sectional detail of a portion of the side wall of the cover taken on line 8—8 of FIG. 2.

One side of the cover 1 of FIG. 4 may be cut off at line 5—5 to produce the three-sided cover 6 of FIG. 5. A pair of these covers 6 form the adjustable cover 7 of FIGS. 2, 3 and 6 when the two are nested together as shown to form a four-sided cover. The candle holding indentations 3 have yielding, tapering sides 9 to better grasp the candle and to facilitate the nesting together of the holes from the two pieces 6 to stabilize the assembly as shown in the nested indentations 10 of FIG. 6. The sloping sides 4 of the cover may have vertical rib-like protuberences 11 formed by distending the side walls at selected points to enhance rigidity and to further stabilize the joining of the two parts of the adjustable cover as illustrated in the detail shown in FIG. 8 wherein the flutings or protuberences 11 in side walls 4 nest together. To keep the cover 7 above the cake 12 (FIG. 6) high enough so that the candle holding indentations 3 do not touch and mar the icing 13, tubular stand-offs 14 made of thin wall plastic tubing are provided to fit the underside of the indentations 3. As shown in FIG. 6, a small number of these tubes engage the icing 13 and keep the cover 7 from disturbing the appearance of the cake which may be viewed through the transparent cover. These few tubes may be selectively installed at locations that will support the cover and engage the icing or decoration at sites not critical to the decoration.

The pattern of indentations 3 and ribs is arranged on the cover so as to facilitate the joining together of the two parts at different intervals for providing adjustability of one of the dimensions of the rectangle formed by the joining of the two parts of the cover.

Furthermore, when ready to cut the cake, the cover is lifted off, the stand-offs 14 are removed, and the cover put back in place. By pressing the indentations 3 into the top of the cake, marks are produced in the top to provide a cutting guide for cutting uniform portions of the cake.

The location of the indentations and flutings can be arranged to also permit the two parts of the adjustable cover to be reversed to nest snugly together in three-sided form for shipment and storage in minimum space.

Figure 9:
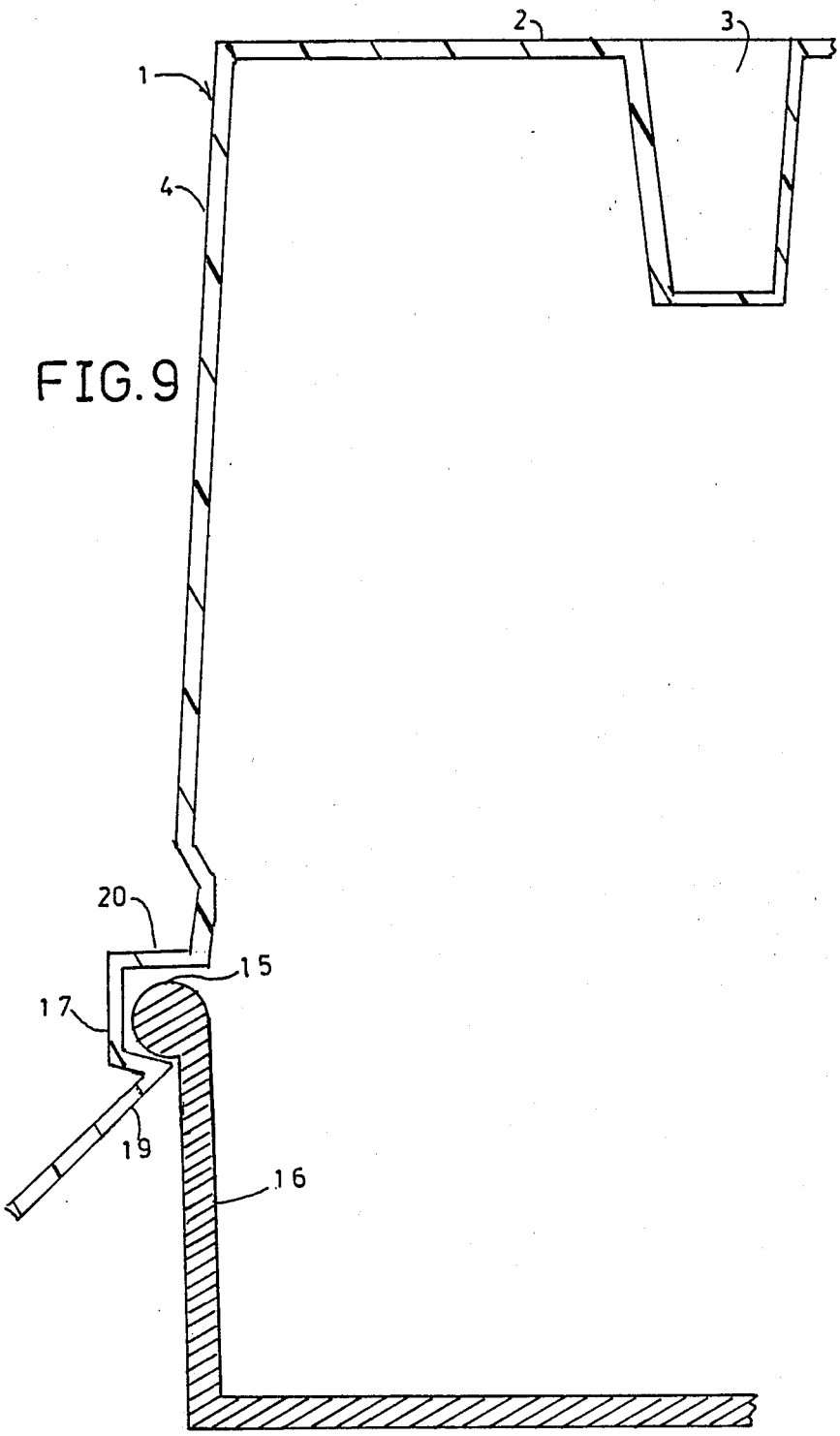
FIG. 9 is a cross sectional view of the edge of a cover with a snap-holding mechanism engaging the edge of a cake pan.

The side walls 4 of the embodiment of the cover 1 illustrate in FIG. 9 terminate at their lowermost edge in a modified flange 17 for latching onto the rim 15 of a cake pan 16. A sloping latching portion 19 slides outwardly when the cover 1 is forced down onto the pan 16 until stop 20 halts downward movement and the sloping portion 19 has passed rim 15, whereupon the flange 17 snaps inwardly, locking onto the rim.

Figure 10:
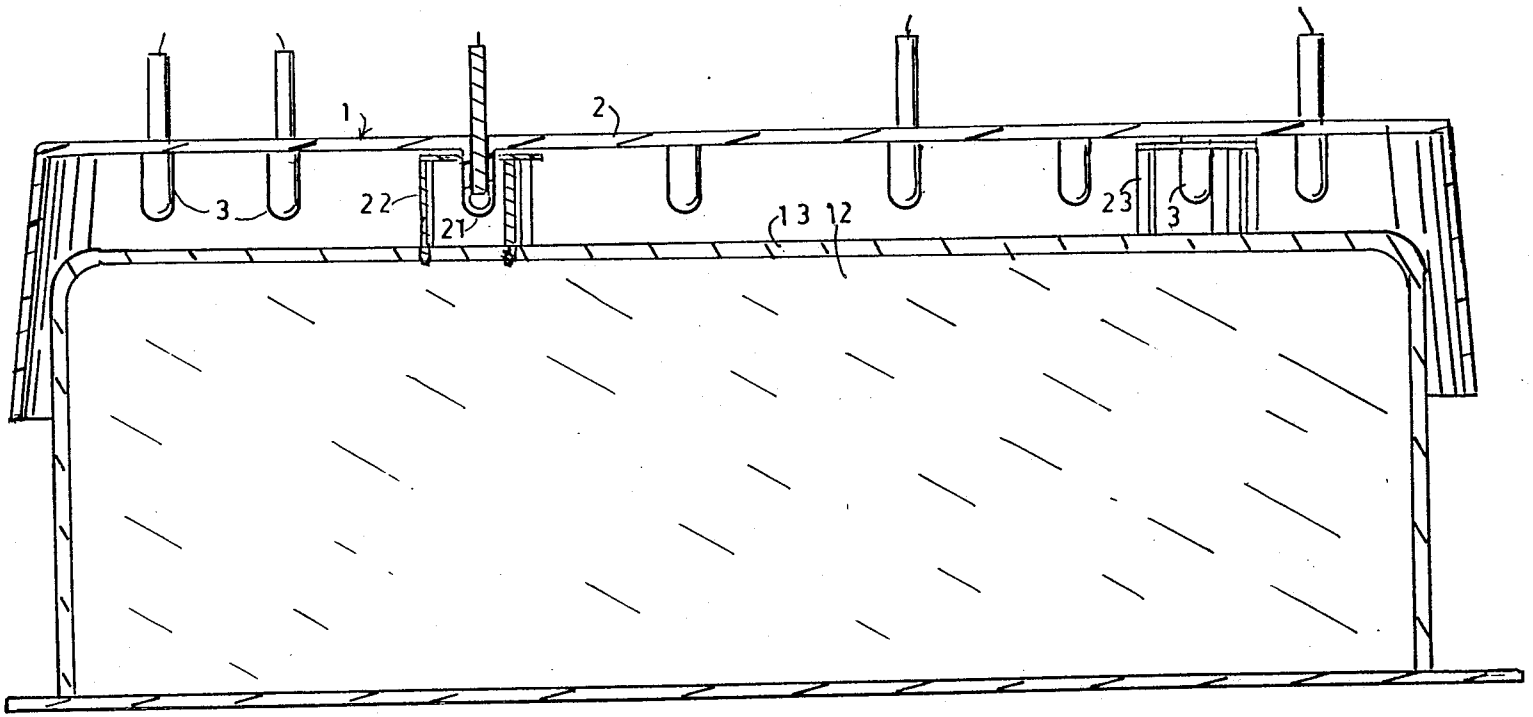
FIG. 10 is a cross sectional view of an embodiment of the invention in use with tripod support elements.

In the embodiment shown in FIG. 10, a rectangular cake 12 with icing 13 is covered by rectangular cover 1. The thickness of the cover is exaggerated for illustrative purposes. It is made of very thin plastic, with a thickness range of 0.010 to 0.050 inches found to represent a satisfactory compromise between strength and economy. The plane of the section passes through one indentation 21 and tripod 22 while other indentations 3 and tripod 23 are outside the plane of the section. FIGS. 11–14 show details of the tripod 23 with a center hole 24 for engaging the outside of the lower portion of the indentation extending below the top 2. The three legs 25 are detachable from the circular plate 26 and engage holding lips 27 molded into the plate 26. A pin 29 at the top of leg 25 engages a hole 30 in plate 26 and stops 31 molded into plate 26 locate the legs on the plate. The tripods disassemble for cleaning and shipping. In FIG. 13 two of the legs are removed. At least two tripods are pushed onto indentations 3 that are selected for locations that will hold the cover 1 in place without marring critical elements of the decorative icing 13 of cake 12. By providing three legs to rest on the cake, a tripod support more stable than the single tubes 14 of FIG. 6 are provided in this embodiment.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A combined candle holder and cake cover for holding candles and protecting rectangular cakes, comprising:

a substantially rectangular, and flat horizontal top having four edges of a transparent material to permit viewing said cake while covered;

a plurality of indentation means in said top extending downwardly below said top, each said indentation means having an opening at its upper end for receiving a candle and a lower portion below said top said lower portions all arranged in a common plane for supporting the lower ends of said candles in a common plane in a substantially vertical position within said indentation means said lower portions providing means for engaging cover support means on the outside of said lower portion;

four sloped sides, one extending downwardly from each of said four edges of said top; and flange means extending horizontally from the lowermost edges of said sides, said sides and flange means providing structural stability to said cover.

2. The cover of claim 1 formed from transparent plastic of thickness less than five one-hundredths of an inch.

3. In the cover of claim 1, said indentation means having tapering side walls providing a reduction in opening in a downward direction for enhanced holding of said candles.

4. The cover of claim 1, including a plurality of tubular elements for attaching to said lower portion of selected indentation means, said tubular elements having two ends, said ends structured for removably attaching to said lower portion of said indentation means at a first end and for resting upon said cake at a second end for raising said cover above said cake to prevent unselected indentation means from marring said cake, wherein said selected indentation means are selected for their locations at sites that will support said cover and not mar important decorative elements of said cake.

5. The cover of claim 1, further comprising vertical rib means embossed in said vertical walls of said cover to enhance the stability of said cover.

6. In the cover of claim 1, said flange means further including engaging means for engaging the rim of a support that supports said cake.

7. The cover of claim 1, including a plurality of support elements for attaching to said lower portion of selected indentation means, said support elements having a first end with indentation-engaging means for attaching to said indentation means and a second end with a plurality of legs for engaging the upper surface of said cake.

8. The cover of claim 7, in which said support elements each have three legs.

9. The cover of claim 7, in which said legs are detachable.

10. In the cover of claim 1, said indentation means arranged in a pattern to provide a cutting guide when said indentation means are pressed into the top of said cake to ensure uniform cut portions of cake.

11. In the cover of claim 6, said engaging means including:

a. latching means, said latching means having an outwardly sloping lowermost portion and, b. stop means, said stop means positioned closer to said top than said latching means to limit the downward motion of said cover on said rim.

12. The cover of claim 1 thermoformed from a single sheet of plastic of a thickness not greater than five one-hundredths of an inch.

13. A combined candle holder and cake cover for holding candles and protecting rectangular cakes of different sizes, comprising:

(A) a first portion, including;

(1) a substantially rectangular, horizontal top of a transparent material to permit viewing said cake while covered;

(2) a plurality of downwardly extending indentation means in said top for holding said candles in a vertical position;

(3) sloped sides extending downwardly from three edges of said top, said top having a free edge without a side;

(4) flange means extending horizontally from the lowermost edges of said sides, said sides and flange means providing structural rigidity to said cover;

(B) a second portion, including;

(1) a substantially rectangular, horizontal top of a transparent material to permit viewing said cake while covered;

(2) a plurality of downwardly extending indentation means in said top for holding said candles in a vertical position;

(3) sloped sides extending downwardly from three edges of said top, said top having a free edge without a side;

(4) flange means extending horizontally from the lowermost edges of said sides, said sides and flange means providing structural rigidity to said cover;

(C) said first portion and said second portion provided with means for nesting together with said free edges overlapping one another for adjusting to said cakes of different size, with said indentation means of said first portion fitting into said indentation means of said second portion at overlapping positions.

14. The cover of claim 13 formed from transparent plastic of thickness less than five one-hundredths of an inch.

15. In the cover of claim 13, said indentation means having tapering side walls providing a reduction in opening in a downward direction for enhanced holding of said candles and nesting of said first and second portions.

16. The cover of claim 13, including a plurality of tubular elements for attaching to the underside of said indentation means, said tubular elements having two ends, a first end constructed for removably attaching the said underside of said indentation means and said second end for resting upon said cake for elevating said cover above said cake sufficient to prevent said indentation means from marring said cake.

17. The cover of claim 13, further including vertical rib means embossed in said vertical walls to enhance the stability of said cover.

18. In the cover of claim 13, said indentation means arranged in a pattern to provide a cutting guide when said indentation means are pressed into the top of said cake to ensure uniform cut portions of cake.

19. In the cover of claim 13, said indentation means arranged to permit said first portion and said second portion to nest together with said free edges together for minimum space shipping and storage.

20. In the cover of claim 13, said flange means including cake pan edge engaging means for locking onto the edge of a cake pan.

21. The cake pan edge engaging means of claim 20, including:

a. latching means, said latching means having an outwardly sloping lowermost portion and, b. stop means, said stop means positioned closer to said top than said latching means to limit the downward motion of said cover on said cake pan edge.

22. The cover of claim 13, including a plurality of support elements for attaching to the lower portion of selected indentation means, said support elements having a first end with indentation-engaging means for attaching to said indentation means and a second end with a plurality of legs for engaging the upper surface of said cake.

23. The cover of claim 22, in which said elements each have three legs.

24. The cover of claim 22, in which said legs are detachable.

* * * * *